US007762267B2

(12) United States Patent
Schmidt

(10) Patent No.: US 7,762,267 B2
(45) Date of Patent: Jul. 27, 2010

(54) FILTER ELEMENT

(75) Inventor: Harald Schmidt, Emmerich (DE)

(73) Assignee: Biotec Biologische Naturverpackungen GmbH & Co. KG, Emmerich (DE)

( * ) Notice: Subject to any disclaimer, the term of this patent is extended or adjusted under 35 U.S.C. 154(b) by 1261 days.

(21) Appl. No.: 10/533,996

(22) PCT Filed: Oct. 16, 2003

(86) PCT No.: PCT/EP03/11493

§ 371 (c)(1),
(2), (4) Date: Dec. 12, 2005

(87) PCT Pub. No.: WO2004/043174

PCT Pub. Date: May 27, 2004

(65) Prior Publication Data

US 2006/0124145 A1 Jun. 15, 2006

(30) Foreign Application Priority Data

Nov. 13, 2002 (DE) ..... 102 52 823

(51) Int. Cl.
*A24D 3/04* (2006.01)

(52) U.S. Cl. ..... 131/339; 131/331; 131/332

(58) Field of Classification Search ..... 131/331, 131/332, 339

See application file for complete search history.

(56) References Cited

U.S. PATENT DOCUMENTS 3,438,381 A * 4/1969 Hale ..... 131/331
4,269,204 A * 5/1981 Yamaguchi ..... 131/341
4,291,712 A * 9/1981 Koster et al. ..... 131/339
4,411,280 A * 10/1983 Floyd et al. ..... 131/332
5,019,262 A * 5/1991 Wang ..... 210/490
5,497,793 A 3/1996 Kubica ..... 131/331
5,516,815 A 5/1996 Buehler et al. ..... 523/128
5,523,036 A 6/1996 Luke et al. ..... 264/45.3
5,568,819 A * 10/1996 Gentry et al. ..... 131/342
5,657,772 A 8/1997 Duke et al. ..... 131/334
5,706,833 A 1/1998 Tsugaya et al. ..... 131/332
5,709,227 A 1/1998 Arzonico et al. ..... 131/341
5,896,860 A * 4/1999 Lockett ..... 131/209
5,947,127 A 9/1999 Tsugaya et al. ..... 131/332
5,954,059 A 9/1999 Beven et al. ..... 131/332
6,062,228 A * 5/2000 Loercks et al. ..... 131/332
6,779,529 B2 * 8/2004 Figlar et al. ..... 131/334
6,814,786 B1 * 11/2004 Zhuang et al. ..... 96/131

FOREIGN PATENT DOCUMENTS

DE 1 161 447 1/1964

(Continued)

*Primary Examiner*—Kat Wyrozebski
*Assistant Examiner*—Daniel Lee
(74) *Attorney, Agent, or Firm*—Workman Nydegger

(57) ABSTRACT

The aim of the invention is to obtain filter tows or filtering materials for manufacturing filters for smoking products which make it possible to prevent or at least reduce health risks due to the release of the filter components and external contamination of cigarettes by filter components. According to the invention, a filter element is manufactured of starch and/or a mixture of a starch-based polymer and eventually incorporated activated-carbon layers and provided with pores and/or channels. The filter particles eventually adherent to such filtering materials or released during cigarette smoking can be dissolved in a corresponding moisture-containing environment. They do not come into consideration for health-damaging effects.

18 Claims, 1 Drawing Sheet

FOREIGN PATENT DOCUMENTS

Figure 1:
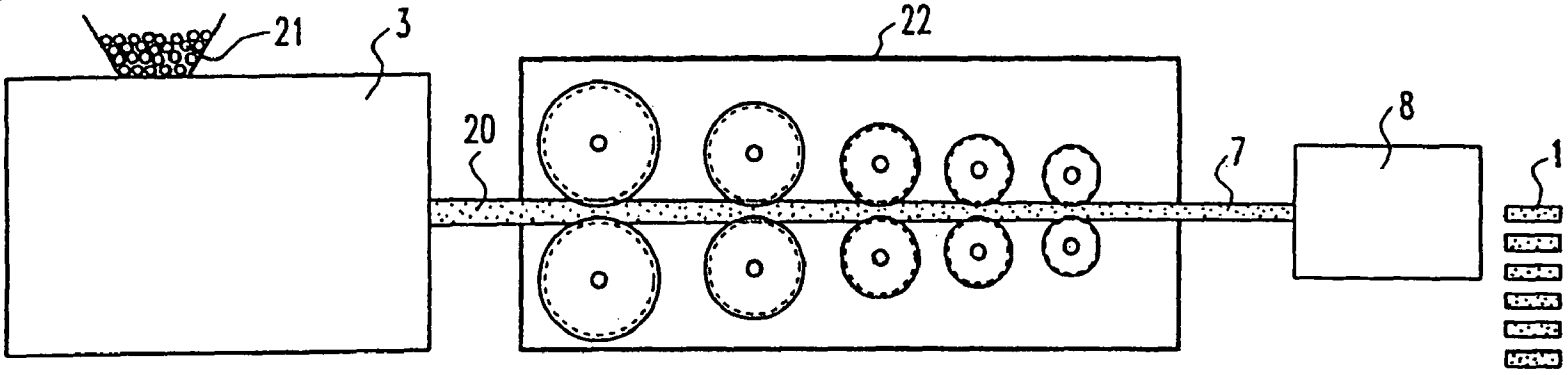

| | | |
|---|---|---|
| DE | 29 47 971 | 6/1980 |
| DE | 33 11 903 | 10/1983 |
| DE | 38 17 889 | 12/1988 |
| DE | 195 36 505 | 4/1997 |
| DE | 694 09 590 | 9/1998 |
| DE | 694 17 366 | 8/1999 |
| EP | 0 541 050 | 5/1993 |
| EP | 0 614 620 | 9/1994 |
| EP | 0 658 320 | 6/1995 |
| EP | 0 777 977 | 6/1997 |
| EP | 0 861 036 | 9/1998 |
| EP | 0 904 705 | 3/1999 |

* cited by examiner

FILTER ELEMENT

The present invention relates to a filter element comprising a biodegradable filtering material which consists mainly of regrowing raw materials and is used, in particular, as a cylindrical tobacco smoke filter of cigarettes, cigars or pipes, as well as to a method for manufacturing the same.

Smoking articles such as, e.g., cigarettes have a cylindrical shape in which the tobacco material to be smoked and being in a shreddered form is surrounded by a paper cover. Most of these cigarettes have a filter on one of their ends, said filter being connected with the cigarette by a band. In literature, filter elements and cigarette filters are often called filter tow. A fibrous material consisting of the materials cellulose 2,5-acetate or polypropylene is normally used for manufacturing cigarette filters. It is moreover known to use activated carbon for removing the toxines contained in the tobacco smoke. In known processes, fibrous cellulose acetate material is essentially manufactured in accordance with the jet spinning method. From the cellulose acetate filaments and/or the jet-spun cellulose acetate fibers, which are crimpled or crushed, the filter tows are first manufactured as filter rods by stretching the crimpled band, increasing its volume, and bringing it to the desired dimension and surrounding it with paper in a formatting means. The cellulose 2,5-acetate raw materials are normally compounded with glyceryle monoacetate as a softener; it is quite problematic that it is contained in the tobacco smoke.

DE 195 36 505 A1 and the corresponding EP 861 036 A disclose a process for manufacturing biodegradable filtering materials which consist of regrowing raw materials and are used as tobacco smoke filter elements of cigarettes, cigars or pipes, wherein a filter tow or filtering material is manufactured from fibers and filaments of biopolymers on the basis of thermoplastic starch and polymer mixtures thereof. In accordance with their purpose, filtering materials are used to hold back toxines from the tobacco smoke. However, it turned out that on the cut surface of cigarette filters there are loose components of filtering materials which cannot be seen easily by the consumer with the naked eye. These components are fragments of the cellulose acetate fibers mostly used in cigarette filters and, in case activated carbon filters are used, these components are carbon particles. Parts of these loose filter components are released when puffing on the cigarettes. For example, when smoking cigarettes having filters that contain activated carbon, carbon particles that might contain tobacco smoke toxines can be released. Furthermore, when, e.g., cutting the filter, fibers or components of the fiber can be released. When smoking and caused by the described filter defects, filter fibers and/or filter particles that are coated with toxines from the tobacco smoke might be inhaled and swallowed. It is therefore at least assumed that, in addition to the considerable health risk associated with the smoking of cigarettes, there is also an additional health risk caused by the release of filter components (cf. "Release of cellulose acetate fibers and carbon particles from cigarette filters", report of the Federal Institute for Health Protection of Consumers and Veterinary Medicine dated Jun. 4, 2002).

With respect to the state of the art, it is furthermore referred to EP 0 658 320 B1, EP 0 636 324 B1 and DE 33 11 903 A1.

It is an object of the present invention to provide a filter tow or filtering material for manufacturing filters for smoking products in which health risks resulting from the release of filter components and the outer contamination of cigarettes with filter components are avoided or at least reduced.

This object is achieved with the features of the claims.

In achieving the object, the invention starts out from the basic idea of providing a filter element consisting of a starch material and/or a starch-based polymer mixture as well as optionally an activated carbon, wherein the filter element comprises pores and/or filter channels. The filter element can contain a filtering material consisting of starch foam, starch polymer fibers or biopolymer films and optionally incorporated activated-carbon layers. Filter particles which might adhere to such filtering materials or are released during smoking can be dissolved in an environment containing a corresponding amount of moisture. They do not come into consideration for the health-damaging effects discussed above. The activated carbon can be provided as powder or granules and can be present in different manners in the filtering material consisting of starch and/or a starch-based polymer mixture. For example, the starch can be foamed and form a base material for the activated carbon. The activated carbon can be sprayed onto a foamed filtering material consisting of a starch material or it can be incorporated as an intermediate layer. The starch material can be planar (e.g. a foamed plate) or foamed into an endless round filter rod and cut into correspondingly formed portions. Natural fibers such as cellulose fibers, hemp or cotton fibers can be included in the filter element in an amount of about 5 percent by volume.

For manufacturing filter elements according to the present invention, such as round filter rods, a layer of activated carbon is applied, e.g. sprayed as a powder, onto cut starch foam portions, or in any other way brought between starch foam portions or arranged thereon. The thus combined and connected layers of starch foam portions and activated carbon are surrounded by a film or provided with any other suitable cover. The round filter rod then comprises stacked disks or layers of starch foam and activated carbon, i.e. layers of starch foam and activated carbon that are alternatingly arranged transversely with respect to the gas flow. Arrangement, thickness, porosity or other parameters of the layers can influence the passage of the flavor-carrying molecules of the tobacco smoke through the filtering material. Possibly also the kind of tobacco and specific desired effects relating to the passage of flavor-carrying molecules (e.g. their number) or other parameters by means of which the tobacco flavor can be influenced play a role.

It is possible to include additional filter channels into the individual layers and/or into the finished filter element, e.g., in order to be able to influence the passage of the flavor-carrying molecules of the tobacco. These filter channels can be made, e.g., by needles, water jets or lasers at any time during the manufacture of the filter elements. The arrangement and thickness of the layers of the filter element are unimportant in this regard. For example, starch foam portions can be stored intermediately and, in accordance with the intended use, they can then optionally be combined with intermediate layers of activated carbon to form filter elements and covered with a film. The filter channels can extend or be orientated approximately in the direction of the gas flow; however, deviations are possible. Moreover, the filter channels can partly extend transversely with respect to the tobacco gas flow. In this case, filter elements being shaped, e.g., as round filter rods can be surrounded with a correspondingly air-permeable and/or perforated paper band, or the filter channels are introduced into the finished round filter rod that is surrounded with a band. The filter channels can have a size or width of preferably 50 to 100 μm, and they can extend into the filter element or round filter rod up to a predetermined depth, e.g. starting out from one or two ends thereof. Furthermore, the filter channels can be orientated in the longitudinal direction and extend through the entire round filter rod. The filtering effect can be influenced by the shape, size, number and arrangement of the filter channels.

When stacking the layers of starch foam and activated carbon, the activated carbon can be present in the form of granules. The coherence of the individual layers of the filter element can be guaranteed substantially by the surrounding material, e.g. a shrinking film.

By incorporating activated carbon into a filtering material or between layers of a filtering material consisting of starch and/or a starch-based polymer mixture, a filter element in which the advantages of both materials are combined is obtained.

For example, about 5 percent by volume of natural fibers (e.g. cotton fibers, cellulose fibers, hemp) can be arranged or incorporated in the filter element in a similar manner as a wick, and they can develop a suction effect so that an additional filtering-out of harmful components from the tobacco smoke is favored.

Starch foam itself does not emit inhalable, volatile products and can absorb the above-mentioned carbon particles that are possibly released. Starch foam particles or starch fiber particles which adhere to the cut surfaces when cutting the cigarette filters are harmless as regards health because they are biodegradable. In an environment in which there is a corresponding amount of moisture, the starch particles or fibers absorb or retain the moisture. During production, the parameters of the used starch materials can be adjusted in such a manner that the moisture content of the air in the lung is sufficient for retaining or dissolving possibly released starch particles or starch fibers to which possibly activated carbon particles and toxines adhere and for transporting the starch particles and fibers out of the lung together with the air during exhalation. Thus, an accumulation in the lung caused by the inhalation of tobacco smoke can be prevented.

Figure 2:
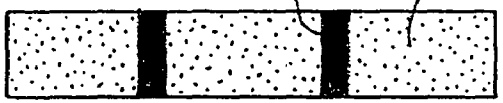
Figure 3:
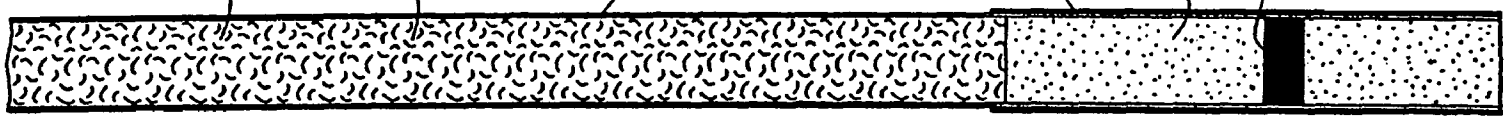

In the following, the invention will be explained in more detail on the basis of the drawings in which FIG. 1 shows a process diagram for the manufacture of filters from starch foam, FIG. 2 shows longitudinal sectional views of individual filter elements, FIG. 3 shows a longitudinal sectional view of a cigarette containing a filter element according to the present invention.

According to the present invention, starch materials having thermoplastic properties that allow them to be processed after adapting the operational conditions, e.g., in the melt-blown method or jet spinning method are used for manufacturing a filter element. Methods which can be used for the present invention are described in detail, e.g., in EP 861 036. In the methods described therein, very fine fibers can be manufactured by means of extrusion systems and specific nozzles as endless fibers (filaments), swirled by air and either elongated (to increase the strength) and subsequently crimpled (jet spinning method) or not elongated in order to achieve a soft, fleeced structure having a large surface (melt-blown method).

When manufacturing a filtering material for a filter element according to the invention in accordance with the jet spinning method, the extruded fibers are first spun and combined to a bundle of fibers, and after drawing they are then formed to an endless filter by means of compression rolls. In a method for manufacturing the filter elements of the present invention from starch polymer fibers, a final shaping takes place in a configuration system, wherein the endless filter is optionally again supplied to a compression and crushing machine and processed to individual filter portions in a filter rod machine.

For manufacturing starch foam by means of extrusion, the starch is preferably gelatinized in a twin-screw extruder Continua 37® under pressure and temperature, destructured and extruded as a foam hank. As schematically shown in FIG. 1, starch foam 20 consisting of a base mixture 2 of starch, preferably native potato starch, and plastifying and film-forming additives is compressed, optionally modified, plastified and expanded by a pressure and temperature decrease in an extrusion system 3 by supplying thermal and mechanical energy and compressed in a compression step, wherein it is processed to become an endless filter 7 in a calendar system 22. A foamed round profile having a diameter of 10 mm is manufactured and calibrated in the formatting process to a diameter of 7.8 mm. The specific volume weight of the foam filter hank is, e.g., about 12 kg/m$^3$. The extruded starch foam 20 is substantially open-pored so that the foamed filtering material being formed of destructured starch having a crystalline content of less than 5% is able to absorb the liquids and liquid harmful substances contained in the tobacco smoke, such as condensate and tar products, wherein the starch foam itself does not emit any inhalable, volatile products into the tobacco smoke.

The further shaping and separation into short filter rods or filter portions 1 is performed in a configuration system 8. According to the present invention, the endless filter is cut into filter portions and processed to become a filter element or cigarette filter having a shacked configuration of starch-based filter portions optionally alternatingly with layers of activated carbon (as shown in FIG. 3).

Although an extruded product having an air-permeable configuration is formed in accordance with the present invention, a large range is possible for the air permeability. For example, the extruded product can be substantially open-pored so that a high air-permeability can be expected. However, the extruded product can also be partly close-pored so that the air-permeability is correspondingly low. For being able to adjust the filtering material for tobacco smoke filters to specific filtering properties, a suitable number of additional filter channels having a suitable size can be introduced.

According to the present invention, the filter channels can be introduced into a filtering material consisting of a starch material by means of needles, water jets or a laser beam. In a layered filter element (round filter rod), the thickness of each filter layer of starch material and optionally activated carbon and the laser depth, which corresponds to the channel length, are adjusted. Although a filtering material of a foamed starch material can be open-pored, additionally introduced filter channels can intensify the advantageous properties, such as the adhesion properties, of this filtering material. Moreover, a filtering material of, e.g., starch polymer fibers exhibits improved adhesion properties of the harmful particles in the tobacco smoke that should be filtered. A filtering material consisting of a fibrous starch material can be cut into stack fibers, wherein the ends of the short fibers extend, e.g., into filter channels being additionally included into the filtering material, so that it is possible to further improve the filtering properties. FIG. 3 shows a longitudinal sectional view of a cigarette 10 comprising a filter element 1, which is manufactured in accordance with the method shown in FIG. 1, wherein a portion containing tobacco 11 and a portion containing the filter element 1 are surrounded by cigarette paper 12 and connected, and the filter element 1 and the transitional region towards the portion containing the tobacco 11 are surrounded by a further band 13 for the purpose of strengthening. The filter element 1 has a stacked configuration (cf. FIG. 2), wherein layers of starch foam 20 and layers of activated carbon 21 are arranged alternatingly.

The method conditions and recipes for the one-step method and manufacture of a substantially elastic compressible filter tow consisting of starch foam and having an open-pored foam structure, as disclosed in EP 861 036, can be used for the present invention.

The invention claimed is:

1. A filter element for manufacturing tobacco smoke filters comprising:

a filtering material forming a filter element body having an outer surface and an interior portion extending longitudinally from a first end to a second end and which substantially contains starch and/or a starch-based polymer mixture and comprises pores and/or filter channels extending substantially longitudinally and continuously through the interior portion of the filter element body so as to be open in the direction of gas flow, the pores and/or filter channels having a diameter in a range of about 50 μm to about 100 μm, wherein the filtering material is arranged in alternatingly succeeding layers comprised of starch and/or a starch-based polymer mixture and activated carbon and the layers are stacked transversely with respect to the direction of gas flow.

2. The filter element according to claim 1, wherein the starch and/or the starch-based polymer mixture form(s) a base material for the activated carbon.

3. The filter element according to claim 1, wherein the starch and/or starch-based polymer mixture is a foamed material or a fibrous material.

4. The filter element according to claim 3, wherein the activated carbon is an activated-carbon powder, wherein the foamed material or the fibrous material forms a base material for the activated-carbon powder.

5. The filter element according to claim 1, the filtering material further comprising natural fibers selected from the group consisting of cellulose fibers, hemp, and cotton fibers in an amount of about 5 percent by volume.

6. A method for manufacturing a filter element according to claim 1 comprising the steps of:

(a) continuously supplying a metered mixture of starch and/or a starch-based polymer mixture as well as further additives into an extruder system, (b) heating and kneading the mixture at a defined temperature and pressure regime for forming a melt, (c) extruding the melt through a nozzle, (d) forming an extruded product having an air-permeable configuration (e) compressing the extruded product and forming a filtering material as an endless filter, (f) separating the extruded filtering material into portions, and (g) forming a filter element comprised of at least one filtering material portion.

7. A method for manufacturing a filter element according to claim 1 comprising the steps of:

(a) continuously supplying a metered mixture of starch and/or a starch-based polymer mixture as well as further additives into an extruder system, (b) heating and kneading the mixture at a defined temperature and pressure regime for forming a melt, (c) extruding the melt through a nozzle, (d) forming an extruded product having an air-permeable configuration, (e) compressing the extruded product and forming a filtering material as an endless filter, (f) separating the extruded filtering material into portions, and (g) forming a filter element consisting of two or more filtering material portions and each comprising an activated carbon layer between subsequent filtering material portions.

8. The method according to claim 6, wherein the filter channels in the interior of the filter element body are introduced into the filtering material portions before forming the filter element.

9. The method according to claim 8, wherein the filter channels are formed by water jets, needles or a laser beam.

10. The method according to claim 6, wherein the filtering material is formed of starch foam, a biopolymeric film or a starch polymer film.

11. The method according to claim 6, wherein the further additives are selected from the group consisting of polyvinyl alcohol, polyester amide and/or polyester urethane, polyactic acid (PLA), poly hydroxy butyric acid (PHB), a flowing assistant, and a foaming agent.

12. A filter element for manufacturing tobacco smoke filters comprising:

a filtering material forming a filter element body having an outer surface and an interior portion extending longitudinally from a first end to a second end and which substantially contains starch and/or a starch-based polymer mixture and includes a plurality of pores and/or filter channels extending substantially longitudinally all the way through the interior portion of the filter element body and being aligned partly transversely relative to the direction of gas flow through the interior portion of the filter element body, the pores and/or filter channels having a diameter of less than about 100 μm, wherein the filtering material is arranged in alternatingly succeeding layers comprised of starch and/or a starch-based polymer mixture and activated carbon and the layers are stacked transversely with respect to the direction of gas flow.

13. The filter element according to claim 12, wherein the filter element body further comprises pores and/or filter channels that are generally aligned in the direction of gas flow through the interior portion of the filter element body.

14. The filter element according to claim 12, wherein the pores and/or filter channels in the interior portion of the filter element body have a diameter in a range of about 50 μm to about 100 μm.

15. A filter element for manufacturing tobacco smoke filters comprising:

a filtering material forming a filter element body having an outer surface and an interior portion which contains substantially starch and/or a starch-based polymer mixture and about 5% by volume of natural cellulose fibers, and which includes a plurality of pores and/or filter channels extending at least partially through the interior portion of the filter element body, wherein the filtering material is arranged in alternatingly succeeding layers comprised of starch and/or a starch-based polymer mixture and activated carbon and the layers are stacked transversely with respect to the direction of gas flow.

16. The filter element according to claim 15, wherein the pores and/or filter channels through the interior portion of the filter element body are generally aligned in the direction of gas flow through the filtering material.

17. The filter element according to claim 15, wherein the pores and/or filter channels have a diameter in a range of about 50 μm to about 100 μm.

18. The filter element according to claim 15, wherein the natural cellulose fibers comprises at least one of cotton or hemp fibers.

* * * * *

UNITED STATES PATENT AND TRADEMARK OFFICE

CERTIFICATE OF CORRECTION

PATENT NO. : 7,762,267 B2
APPLICATION NO. : 10/533996
DATED : July 27, 2010
INVENTOR(S) : Schmidt It is certified that error appears in the above-identified patent and that said Letters Patent is hereby corrected as shown below:

Drawings

Sheet 1, replace Figure 1 with the figure depicted below, wherein the reference number "21" has been changed to --2--

Fig. 1

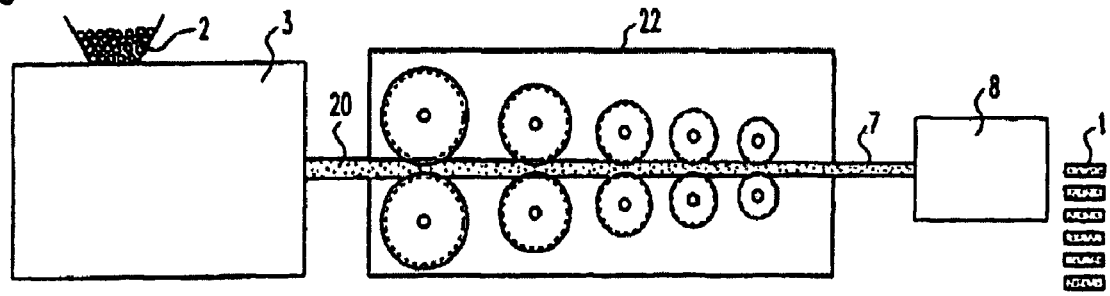

Column 3

Line 31, change "which" to --which:--

Column 5

Line 40, change "configuration" to --configuration,--

Column 6

Line 63, change "comprises" to --comprise--

Signed and Sealed this
Eighteenth Day of January, 2011

David J. Kappos

David J. Kappos
*Director of the United States Patent and Trademark Office*